US009757759B2

(12) United States Patent
Topf et al.

(10) Patent No.: US 9,757,759 B2
(45) Date of Patent: Sep. 12, 2017

(54) METHOD AND APPARATUS FOR CONCURRENTLY DISPENSING AND FAIRING HIGH VISCOSITY FLUID

(71) Applicant: The Boeing Company, Chicago, IL (US)

(72) Inventors: Richard Philip Topf, Orange, CA (US); Martin Hanna Guirguis, Long Beach, CA (US); Don David Trend, Huntington Beach, CA (US); Angelica Davancens, Reseda, CA (US)

(73) Assignee: THE BOEING COMPANY, Chicago, IL (US)

( * ) Notice: Subject to any disclaimer, the term of this patent is extended or adjusted under 35 U.S.C. 154(b) by 346 days.

(21) Appl. No.: 13/963,218

(22) Filed: Aug. 9, 2013

(65) Prior Publication Data

US 2015/0044376 A1 Feb. 12, 2015

(51) Int. Cl.

| | |
|---|---|
| ***B05D 1/26*** | (2006.01) |
| ***B05D 3/12*** | (2006.01) |
| ***B05C 9/12*** | (2006.01) |
| ***B05C 17/005*** | (2006.01) |
| ***E04F 21/165*** | (2006.01) |

(52) U.S. Cl.

CPC ..... *B05C 9/12* (2013.01); *B05C 17/00516* (2013.01); *B05D 1/26* (2013.01); *B05D 3/12* (2013.01); *E04F 21/1652* (2013.01)

(58) Field of Classification Search

CPC ..... B05C 17/00516; B05C 9/12; B05D 1/26; B05D 3/12; E04F 21/1652

USPC ..... 427/355

See application file for complete search history.

(56) References Cited

U.S. PATENT DOCUMENTS

| | | | |
|---|---|---|---|
| 1,003,650 | A | 9/1911 | Redin |
| 1,909,146 | A | 5/1933 | Bohanan |
| 1,988,557 | A | 1/1935 | Jecker |
| 2,126,999 | A | 8/1938 | Mitchell |
| 2,227,792 | A | 1/1941 | Norton, Jr. |
| 2,608,705 | A | 9/1952 | Duff |
| 2,609,974 | A | 9/1952 | Brous |

(Continued)

FOREIGN PATENT DOCUMENTS

| | | | |
|---|---|---|---|
| CN | 101858456 | B | 12/2012 |
| DE | 102004027789 | A1 | 2/2005 |

(Continued)

OTHER PUBLICATIONS

PPG Semco® Fillet Nozzles, PPG Aerospace, [online], [retrieved on Aug. 21, 2013] Retrieved online from<http://www.ppg.com/coatings/aerospace/semcoappsys/ semcosystems/semcopkg products/nozzlessmoothingtools/Pages/filletNozzles.aspx>, 2 pages.*

(Continued)

*Primary Examiner* — Alexander Weddle

(74) *Attorney, Agent, or Firm* — Yee & Associates, P.C.

(57) ABSTRACT

A method and apparatus for forming and shaping a fillet at an interface. A fluid may be dispensed from a nozzle onto the interface as the nozzle is moved along the interface to form the fillet. An exposed surface of the fillet may be worked using a fairing element associated with the nozzle, as the nozzle is moved along the interface and the fluid is dispensed from the nozzle.

10 Claims, 11 Drawing Sheets

(56) References Cited

U.S. PATENT DOCUMENTS

| | | | | |
|---|---|---|---|---|
| 2,824,443 | A | 2/1958 | Ames | |
| 2,978,722 | A | 4/1961 | Kusakabe | |
| 3,378,331 | A | 4/1968 | Beasley | |
| 3,661,679 | A | 5/1972 | Law | |
| 3,746,253 | A | 7/1973 | Walberg | |
| 3,865,525 | A | 2/1975 | Dunn | |
| 3,888,421 | A | 6/1975 | Chow | |
| 4,239,157 | A | 12/1980 | Fasth | |
| 4,570,834 | A | 2/1986 | Ward | |
| 4,635,827 | A * | 1/1987 | Roedig | B05C 7/00 118/410 |
| 4,698,005 | A | 10/1987 | Kikuchi et al. | |
| 4,925,061 | A | 5/1990 | Jeromson, Jr. et al. | |
| 4,932,094 | A | 6/1990 | McCowin | |
| 4,944,459 | A | 7/1990 | Watanabe et al. | |
| 4,948,016 | A | 8/1990 | Summons et al. | |
| 4,989,792 | A | 2/1991 | Claassen | |
| 5,017,113 | A | 5/1991 | Heaton et al. | |
| 5,060,869 | A | 10/1991 | Bekius | |
| 5,186,563 | A | 2/1993 | Gebhard et al. | |
| 5,271,521 | A | 12/1993 | Noss et al. | |
| 5,271,537 | A | 12/1993 | Johnson | |
| 5,319,568 | A | 6/1994 | Bezaire | |
| 5,346,380 | A | 9/1994 | Ables | |
| 5,462,199 | A | 10/1995 | Lenhardt | |
| 5,480,487 | A | 1/1996 | Figini et al. | |
| 5,571,538 | A | 11/1996 | Cloud | |
| 5,615,804 | A | 4/1997 | Brown | |
| 5,803,367 | A | 9/1998 | Heard et al. | |
| 5,906,296 | A | 5/1999 | Martindale et al. | |
| 5,920,974 | A | 7/1999 | Bullen | |
| 5,976,631 | A | 11/1999 | Ramachandran | |
| 5,992,686 | A | 11/1999 | Cline et al. | |
| 5,995,909 | A | 11/1999 | Bretmersky et al. | |
| 6,001,181 | A | 12/1999 | Bullen | |
| 6,082,587 | A | 7/2000 | Martindale et al. | |
| 6,213,354 | B1 | 4/2001 | Kay | |
| 6,471,774 | B1 | 10/2002 | Krueger | |
| 6,536,969 | B2 | 3/2003 | Nishitani | |
| 6,698,617 | B1 | 3/2004 | Szymanski | |
| 6,739,483 | B2 | 5/2004 | White et al. | |
| 6,935,541 | B1 | 8/2005 | Campbell et al. | |
| 6,942,736 | B2 | 9/2005 | Chinander et al. | |
| 6,986,472 | B2 | 1/2006 | Gordon | |
| 7,101,107 | B1 | 9/2006 | Byun | |
| 7,172,096 | B2 | 2/2007 | O'Dougherty | |
| 7,275,663 | B2 | 10/2007 | Campbell et al. | |
| 7,578,416 | B2 | 8/2009 | Underwood | |
| 7,592,033 | B2 | 9/2009 | Buckley et al. | |
| 7,815,132 | B2 | 10/2010 | Baltz | |
| 7,922,107 | B2 | 4/2011 | Fox | |
| 8,181,822 | B2 | 5/2012 | Doelman et al. | |
| 8,453,876 | B2 | 6/2013 | Miller | |
| 8,534,499 | B2 | 9/2013 | Williams et al. | |
| 8,651,046 | B1 | 2/2014 | Davancens et al. | |
| 9,016,530 | B2 | 4/2015 | Topf et al. | |
| 2003/0156401 | A1 | 8/2003 | Komine et al. | |
| 2004/0129208 | A1 | 7/2004 | Nolte et al. | |
| 2004/0192524 | A1 | 9/2004 | Nolte et al. | |
| 2005/0145724 | A1 | 7/2005 | Blette et al. | |
| 2006/0081175 | A1 | 4/2006 | Nagase | |
| 2010/0260531 | A1 | 10/2010 | Rademacher | |
| 2011/0297175 | A1 | 12/2011 | Pires et al. | |
| 2012/0273115 | A1 | 11/2012 | Suzuki et al. | |
| 2014/0234011 | A1 | 8/2014 | Tomuta et al. | |
| 2014/0326760 | A1 | 11/2014 | Topf et al. | |
| 2015/0028051 | A1 | 1/2015 | Topf et al. | |
| 2015/0053787 | A1 | 2/2015 | Tomuta et al. | |
| 2015/0064357 | A1 | 3/2015 | Tomuta et al. | |
| 2016/0175883 | A1 | 6/2016 | Tomuta et al. | |

FOREIGN PATENT DOCUMENTS

| | | | |
|---|---|---|---|
| DE | 202005005619 | U1 | 2/2006 |
| DE | 102004042211 | A1 | 3/2006 |
| DE | 102008010169 | A1 | 9/2009 |
| DE | 202007019244 | U1 | 8/2011 |
| DE | 102010030375 | A1 | 12/2011 |
| EP | 0181483 | A1 | 5/1986 |
| EP | 1245348 | A1 | 10/2002 |
| EP | 1425107 | B1 | 5/2006 |
| EP | 2277631 | A1 | 1/2011 |
| EP | 2839885 | A1 | 2/2015 |
| FR | 2508350 | A1 | 12/1982 |
| GB | 2282554 | A | 4/1995 |
| GB | 2481299 | A | 12/2011 |
| JP | S5827672 | A | 3/1983 |
| JP | 2002059049 | A | 2/2002 |
| WO | WO0067915 | A1 | 11/2000 |
| WO | WO2005012845 | A2 | 2/2005 |
| WO | WO2010093494 | A1 | 8/2010 |
| WO | WO2011108358 | A2 | 9/2011 |
| WO | WO2013112178 | A1 | 8/2013 |

OTHER PUBLICATIONS

PPG Semco® Specialty Application Nozzles, Technical Data. PPG Industries Semco Packaging & Application Systems, [online] [retrieved on Aug. 21, 2013] Retrieved online from <http://www.ppg.com/coating/aerospace/semcoplg/semco_specialty_application_nozzels.pdf> 2 pages.*

Extended European Search Report, dated Jan. 8, 2015, regarding Application No. EP14180160.5, 6 pages.

Office Action, dated May 11, 2015, regarding U.S. Appl. No. 14/016,846, 36 pages.

Notice of Allowance, dated Mar. 27, 2015, regarding U.S. Appl. No. 13/951,817, 12 pages.

Canadian Intellectual Property Office Examination Search Report, dated Jun. 10, 2015, regarding Application No. 2,858,185, 5 pages.

Canadian Intellectual Property Office Examination Search Report, dated Aug. 5, 2015, regarding Application No. 2,855,480, 4 pages.

Office Action, dated Aug. 25, 2015, regarding U.S. Appl. No. 13/769,569, 44 pages.

Final Office Action, dated Sep. 1, 2015, regarding U.S. Appl. No. 14/016,846, 10 pages.

International Search Report and Written Opinion, dated Oct. 7, 2014, regarding Application No. PCT/US2014/040989, 10 pages.

Extended European Search Report, dated Oct. 15, 2014, regarding Application No. 14175644.5, 6 pages.

International Search Report and Written Opinion, dated Oct. 15, 2014, regarding Application No. PCT/US2014/045018, 9 pages.

Office Action, dated Oct. 1, 2014, regarding U.S. Appl. No. 13/886,535, 17 pages.

Notice of Allowance, dated Dec. 19, 2014, regarding U.S. Appl. No. 13/886,535, 13 pages.

Office Action, dated Nov. 28, 2014, regarding U.S. Appl. No. 13/951,817, 17 pages.

Topf et al., "Control Valve Having a Disposable Valve Body," U.S. Appl. No. 13/886,535, filed May 3, 2013, 52 pages.

International Search Report and Written Opinion, dated Apr. 4, 2014, regarding Application No. PCT/US2014/011879, 9 pages.

International Search Report and Written Opinion, dated Jun. 4, 2014, regarding Application No. PCT/US2014/033738, 9 pages.

Davancens et al., "Robotic Sealant and End Effector,"U.S. Appl. No. 12/842,247, filed Jul. 23, 2010, 41 pages.

Tomuta et al., "Fluid Application Device," U.S. Appl. No. 13/769,569, filed Feb. 18, 2013, 63 pages.

Topf et al., "Feedback Control System for Performing Fluid Dispensing Operations," U.S. Appl. No. 13/951,817, filed Jul. 26, 2013, 51 pages.

Tomuta et al., "Method and Apparatus for Exchanging Nozzles and Tips for a Fluid Dispensing System," U.S. Appl. No. 13/973,528, filed Aug. 22, 2013, 64 pages.

(56) References Cited

OTHER PUBLICATIONS

Tomuta et al., "Fluid Application Device," U.S. Appl. No. 14/016,846, filed Sep. 3, 2013, 59 pages.
"Compliance Nozzle," 1208-178-000 part specifications, Sealant Equipment and Engineering, Inc., 2 pages, accessed Apr. 9, 2013, http://sealantequipment.com/pdf/DispenseValves/1208-178 %20Compliance%20Nozzle.pdf.
"Dispense Valves for Adhesives, Sealants, Lubricants, Epoxy, Polyurethane, Silicone & More," Kiss, No-Drip, Snuf-Bak, Tip-Seal, Manual, Metering, and High Flow valve part specifications, Sealant Equipment and Engineering, Inc., 12 pages, accessed Apr. 9, 2013, http://www.sealantequipment.com/dispensevalves-1part.htm.
"No-Drip Air Operated Fluid Dispense Valve," 2100-108 Series part specifications, Sealant Equipment and Engineering, Inc., 2 pages, accessed Apr. 9, 2013, http://www.sealantequipment.com/pdf/DispenseValves/2100-108%20No-Drip%20Valves.pdf.
Office Action, dated Jun. 17, 2016, regarding U.S. Appl. No. 13/769,569, 13 pages.
Office Action, dated Sep. 22, 2016, regarding U.S. Appl. No. 13/973,528, 71 pages.
Final Office Action, dated Dec. 23, 2016, regarding U.S. Appl. No. 13/973,528, 22 pages.
Final Office Action, dated Dec. 30, 2016, regarding U.S. Appl. No. 13/769,569, 19 pages.
European Patent Office Communication, dated Nov. 30, 2016, regarding Application No. EP14703214.8, 6 pages.
State Intellectual Property Office of PRC Notification of First Office Action and English Translation, issued Nov. 28, 2016, regarding Application No. 201480008306X, 42 pages.
Canadian Intellectual Property Office Examination Report, dated Dec. 21, 2016, regarding Application No. 2,898,323, 3 pages.
Final Office Action, dated Feb. 8, 2016, regarding U.S. Appl. No. 13/769,569, 18 pages.
European Patent Office Communication, dated Mar. 22, 2017, regarding USPTO Application No. 14180160.5, 4 pages.
Office Action, dated May 19, 2017, regarding U.S. Appl. No. 13/973,528, 23 pages.
Canadian Intellectual Property Office Examination Report, dated Apr. 21, 2017, regarding Application No. 2,855,480, 4 pages.
State Intellectual Property Office of PRC Notification of First Office Action and English Translation, dated Apr. 24, 2017, regarding Application No. 201480045021.3, 19 pages.

* cited by examiner

1700

1702
SPECIFICATION AND DESIGN
1704
MATERIAL PROCUREMENT
1706
COMPONENT AND SUBASSEMBLY MANUFACTURING
1708
SYSTEM INTEGRATION
1710
CERTIFICATION AND DELIVERY
1712
IN SERVICE
1714
MAINTENANCE AND SERVICE

1800

AIRCRAFT
1802
AIRFRAME
INTERIOR
1806
SYSTEMS
PROPULSION SYSTEM
ELECTRICAL SYSTEM
1808
1812
1810
1814
1804
HYDRAULIC SYSTEM
ENVIRONMENTAL SYSTEM

METHOD AND APPARATUS FOR CONCURRENTLY DISPENSING AND FAIRING HIGH VISCOSITY FLUID

BACKGROUND INFORMATION

1. Field

The present disclosure relates generally to a nozzle and, in particular, to a nozzle for a fluid dispensing system. Still more particularly, the present disclosure relates to an apparatus and method for concurrently dispensing a fluid through a nozzle and fairing a surface of the fluid deposited to form a fillet using the nozzle.

2. Background

Some manufacturing and assembly operations may require that a material be applied to the interface between two or more components to seal the interface, prevent a leakage of fluid through the interface, and/or reduce undesired electromagnetic effects at the interface. Oftentimes, the material used may include, for example, without limitation, a sealant material, a caulking material, an adhesive material, and/or some other type of material.

As one illustrative example, a first component and a second component may be joined to form an interface that is a corner. The corner may be an interior corner, which may be also referred to as an internal corner. A material, such as a sealant material, may be dispensed as a fluid and applied to the corner to form a fillet at this corner.

As used herein, a "fillet" may be a filling of an interior corner in which the filling has at least one surface that contacts the first component, at least one surface that contacts the second component, and at least one surface that contacts neither the first component nor the second component.

The fluid forming the fillet may then be allowed to cure, or harden, to form a seal at the interface. In some cases, the shape of the surface of the fillet not in contact with the first component or the second component may need to be changed. For example, without limitation, the fillet may need to be reworked such that the seal that will be formed has a surface shape that is resistant to inconsistencies. In one illustrative example, the fillet may be reworked such that the shape of the surface of the fillet not in contact with the first component or the second component has a curved shape with a desired radius of curvature. The curved shape may be, for example, a concave shape with respect to the corner. Depending on the implementation, the curved shape may have a constant and/or varying radius of curvature.

The curved shape desired for the fillet may be selected such that the seal formed at the corner has a reduced likelihood of peeling away from the corner over time or separating from the surfaces of the components joined at the corner. Some currently available techniques for forming fillets may include dispensing a bead of fluid at a corner using a dispensing device to form a fillet. Thereafter, one or more other tools may be used to rework the surface shape of the fillet such that the surface shape has a desired shape. The reworking of the surface shape may include fairing the surface of the fillet. As used herein, "fairing" may mean smoothing out, rounding, and/or reshaping the surface shape in some other manner after the fluid has been applied but prior to solidification of the fluid. In other words, fairing may be performed while the fluid that was applied to form the fillet is still workable.

The process of dispensing fluid to form a fillet and then reworking the surface shape of the fillet, as described above, may be more time-consuming than desired. In particular, using multiple tools to perform these different operations may be more time-consuming and, in some cases, more expensive, than desired. Therefore, it would be desirable to have a method and apparatus that take into account at least some of the issues discussed above, as well as other possible issues.

SUMMARY

In one illustrative embodiment, an apparatus may comprise a nozzle and a fairing element associated with the nozzle. The nozzle may be configured to dispense a fluid onto an interface as the nozzle is moved along the interface to form a fillet. The fairing element may be configured to work an exposed surface of the fillet as the nozzle is moved along the interface and the fluid is being dispensed from the nozzle.

In another illustrative embodiment, a fluid dispensing system may comprise a structure, a nozzle associated with the structure, and a fairing element associated with the nozzle. The structure may be configured for association with a fluid source. The nozzle may be configured to receive a fluid from the fluid source through the structure. The nozzle may be further configured to dispense the fluid onto an interface through an opening in the nozzle as the nozzle is moved along the interface to form a fillet at the interface. The opening may have a position that is one of on-center and off-center relative to a center axis of the structure. The fairing element may be configured to fair an exposed surface of the fillet such that a cross-sectional shape of the exposed surface takes on a desired cross-sectional shape in a single pass of the nozzle being moved along the interface while the fluid is being dispensed from the nozzle. The fairing element may have a curved shape configured to shape the exposed surface of the fillet to have the desired cross-sectional shape as the nozzle is moved along the interface and the fluid is being dispensed from the nozzle. The curved shape may comprise at least one of a spherical shape, a convex shape, a concave shape, and a semi-spherical shape. The curved shape may have a size selected based on at least one of a size or a shape of the interface.

In yet another illustrative embodiment, a method for forming and shaping a fillet at an interface may be provided. A fluid may be dispensed from a nozzle onto the interface as the nozzle is moved along the interface to form the fillet. An exposed surface of the fillet may be worked using a fairing element associated with the nozzle, as the nozzle is moved along the interface and the fluid is dispensed from the nozzle.

In still another illustrative embodiment, a method for concurrently forming and shaping a fillet at an interface may be provided. A fluid may be received within a nozzle from a fluid source through a structure with which the nozzle is associated. The nozzle may be moved along the interface. The fluid may be dispensed through an opening in the nozzle onto the interface as the nozzle is being moved along the interface to form the fillet. An exposed surface of the fillet may be faired using a curved shape of a fairing element associated with the nozzle as the nozzle is being moved along the interface and the fluid is being dispensed from the nozzle in a single pass such that a cross-sectional shape of the exposed surface takes on a desired cross-sectional shape. The curved shape may comprise at least one of a spherical shape, a convex shape, a concave shape, and a semi-spherical shape. At least one of a rate or an amount of the fluid being dispensed out of the nozzle may be controlled such that the fairing element is able to work the exposed surface of the fillet to have the desired cross-sectional shape. The nozzle may be moved relative to the structure in a direction along a center axis of the structure as the nozzle is moved along the interface using one of a biasing element and a fluid pressure created by a fluid chamber located between the opening in the nozzle and an end of the structure such that the nozzle maintains contact with the exposed surface of the fillet as the nozzle is moved along the interface.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, without limitation, the illustrative embodiments recognize and take into account that it may be desirable to have a method for both dispensing fluid and fairing a surface of the fluid deposited concurrently. Further, the illustrative embodiments recognize and take into account that it may be desirable to use the same tool to perform both the dispensing operations and the fairing operations included in forming a fillet. Using the same tool for both types of operations may reduce the overall time and cost needed to perform these operations.

Thus, the illustrative embodiments provide a method and apparatus for forming a fillet having a desired surface shape at an interface. In one illustrative embodiment, an apparatus may comprise a structure and a nozzle associated with the structure. The structure may be configured for association with a fluid source. The nozzle may be configured to receive a fluid from the fluid source through the structure. The nozzle may be further configured to dispense the fluid onto an interface as the nozzle is moved along the interface to form a fillet. The nozzle may have an outer nozzle shape configured to work an exposed surface of the fillet as the nozzle is moved along the interface.

Figure 1:
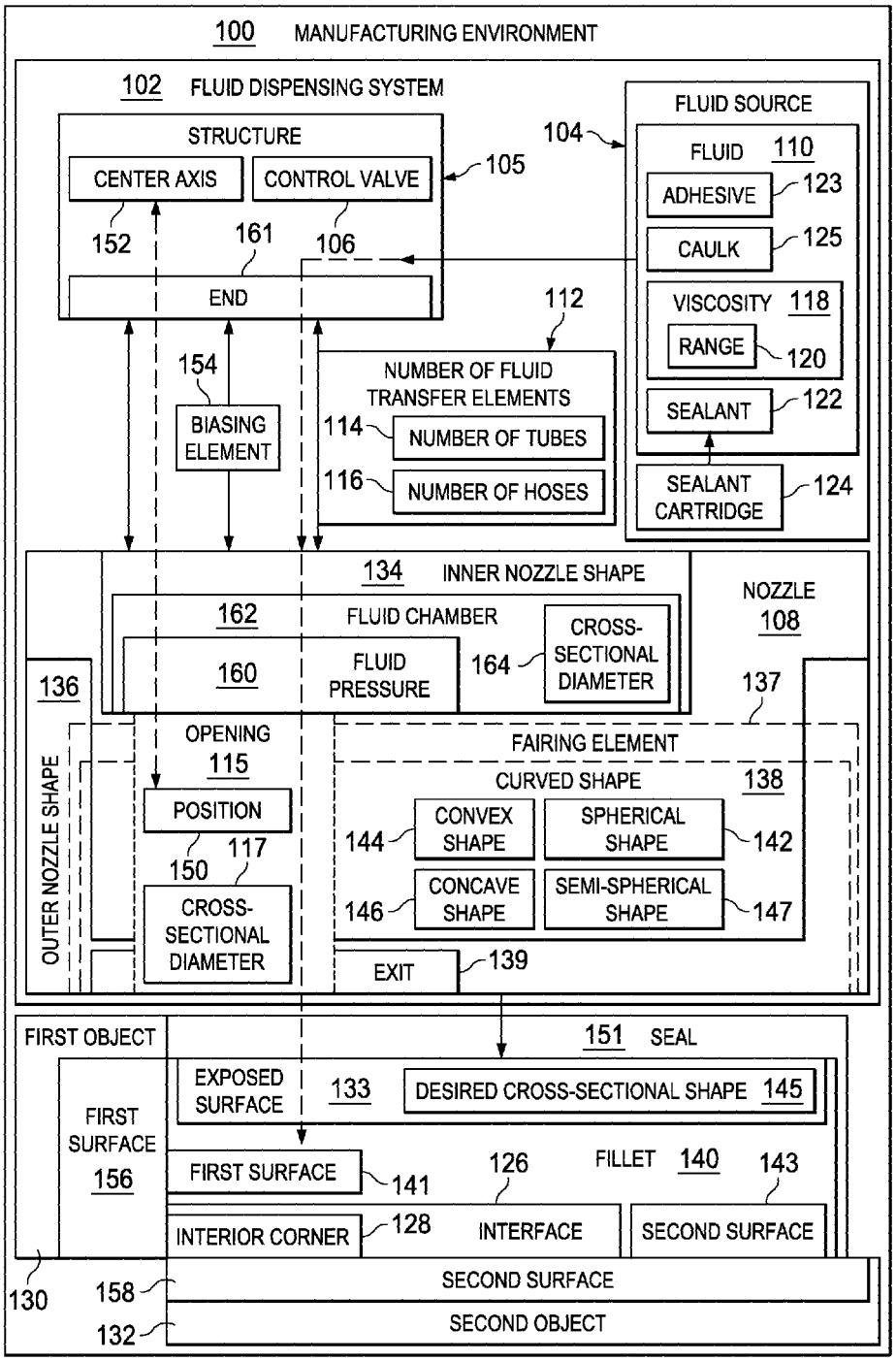
FIG. 1 is an illustration of a manufacturing environment in the form of a block diagram in accordance with an illustrative embodiment.

Referring now to the figures and, in particular, with reference to FIG. 1, an illustration of a manufacturing environment is depicted in the form of a block diagram in accordance with an illustrative embodiment. In this illustrative example, manufacturing environment 100 may be an example of an environment in which fluid dispensing system 102 may be used. As depicted, fluid dispensing system 102 may include fluid source 104, structure 105, and nozzle 108.

Fluid source 104 may hold fluid 110. Structure 105 may be configured to receive fluid 110 from fluid source 104 and allow fluid 110 to flow to nozzle 108. Structure 105 may be comprised of any number of components.

In some cases, structure 105 may include control valve 106. Control valve 106 may be configured to control the flow of fluid 110 to nozzle 108. Nozzle 108 may be the portion of fluid dispensing system 102 through which fluid 110 is dispensed. In other words, fluid 110 may exit fluid dispensing system 102 through nozzle 108.

In these illustrative examples, nozzle 108 may be associated with structure 105. As used herein, when one component is "associated" with another component, the association is a physical association in the depicted examples.

For example, without limitation, a first component, such as nozzle 108, may be considered to be associated with a second component, such as structure 105, by being secured to the second component, bonded to the second component, mounted to the second component, welded to the second component, fastened to the second component, and/or connected to the second component in some other suitable manner. The first component also may be connected to the second component using a third component. Further, the first component may be considered to be associated with the second component by being formed as part of and/or as an extension of the second component.

Although not shown in this example, nozzle 108 may be formed as part of structure 105 in some cases. In this manner, nozzle 108 may be considered a portion of structure 105 in these examples. In other illustrative examples, number of fluid transfer elements 112 may be used to connect nozzle 108 to structure 105. In these examples, fluid 110 may flow through structure 105 to nozzle 108 through number of fluid transfer elements 112.

As used herein, a "number of" items may be one or more items. In this manner, number of fluid transfer elements 112 may be one or more fluid transfer elements. Further, as used herein, a "fluid transfer element," such as one of number of fluid transfer elements 112 may be any element configured to allow fluid 110 to flow through a channel located within the element. In one illustrative example, number of fluid transfer elements 112 may take the form of number of tubes 114. In another illustrative example, number of fluid transfer elements 112 may take the form of number of hoses 116.

Fluid 110 may be dispensed from nozzle 108 through opening 115 in nozzle 108. In other words, opening 115 may be the exit hole in nozzle 108 through which fluid 110 exits nozzle 108. Cross-sectional diameter 117 of opening 115 may be selected such that fluid 110 exits opening 115 with a desired pressure.

For example, without limitation, fluid 110 may have viscosity 118 within range 120. Viscosity 118 may be a measure of the resistance of fluid 110 to gradual deformation by shear stress or tensile stress. In particular, viscosity 118 may indicate the resistance of fluid 110 to flow. A fluid having a higher viscosity may be more resistant to flow than a fluid having a lower viscosity.

Cross-sectional diameter 117 of opening 115 may be selected such that fluid 110 may exit opening 115 with a desired exit pressure, given range 120 of viscosity 118 of fluid 110. Range 120 may be, for example, without limitation, between about 1 centipoise to about 20 centipoise (cP). Of course, in other illustrative examples, viscosity 118 of fluid 110 may fall within some other range.

In one illustrative example, fluid 110 may take the form of sealant 122 and fluid source 104 may take the form of sealant cartridge 124 configured to hold sealant 122. Sealant 122 may be a silicone-based sealant, a sealant for use in fuel tanks, or some other type of sealant. Of course, in other illustrative examples, fluid 110 may take some other form. For example, without limitation, fluid 110 may take the form of adhesive 123, caulk 125, or some other type of fluid having a higher viscosity than water.

In this illustrative example, interface 126 may take a number of different forms. For example, without limitation, interface 126 may take the form of an interior corner, an exterior corner, an edge, an angled joint, or some other type of surface. In one illustrative example, interface 126 may take the form of interior corner 128 formed by first object 130 and second object 132. First object 130 and second object 132 may take the form of, for example, without limitation, a first panel and a second panel, respectively. The angle of interior corner 128 may be any value between about 5 degrees to about 175 degrees.

Nozzle 108 may be used to dispense fluid 110 onto interface 126 while concurrently fairing fluid 110 deposited at interface 126 as nozzle 108 is moved along interface 126. More specifically, nozzle 108 may be used to simultaneously dispense fluid 110, apply fluid 110 onto interface 126, and work fluid 110 deposited at interface 126 as nozzle 108 is moved along interface 126.

For example, without limitation, nozzle 108 may be used to dispense and apply fluid 110 onto interface 126 to form fillet 140. Fillet 140 may be a filling for interface 126. Fillet 140 may be formed such that fillet 140 has first surface 141 that may contact first surface 156 of first object 130, second surface 143 that may contact second surface 158 of second object 132, and exposed surface 133 that may contact neither first object 130 nor second object 132. Nozzle 108 may be configured such that exposed surface 133 of fillet 140 may be worked and reshaped as nozzle 108 is moved along interface 126.

As depicted, nozzle 108 may have inner nozzle shape 134 and outer nozzle shape 136. Inner nozzle shape 134 may be the shape of the channel or hollow portion of nozzle 108 through which fluid 110 is received and dispensed. Outer nozzle shape 136 may be the shape of the outer surface of nozzle 108.

Further, fairing element 137 may be associated with nozzle 108. In this illustrative example, fairing element 137 may be considered part of nozzle 108. Fairing element 137 may be the portion of nozzle 108 that surrounds opening 115 and that comes into contact with fluid 110 that has been deposited at interface 126. In this illustrative example, fairing element 137 may be configured to work exposed surface 133 of fillet 140 while nozzle 108 is being moved along interface 126 and fluid 110 is being dispensed from nozzle 108. In particular, fairing element 137 may be used to fair exposed surface 133.

As depicted, the portion of outer nozzle shape 136 of nozzle 108 belonging to fairing element 137 may be configured such that exposed surface 133 of fillet 140 is faired to have desired cross-sectional shape 145. In this manner, seal 151, formed by fillet 140 when fillet 140, is cured may have exposed surface 133 with desired cross-sectional shape 145.

Desired cross-sectional shape 145 may be a shape in which exposed surface 133 of seal 151 formed by fillet 140 may be within tolerances. For example, without limitation, desired cross-sectional shape 145 may be selected such that seal 151 formed at interface 126 has a reduced likelihood of peeling away from interface 126 over time or separating from first surface 156 of first object 130 and/or second surface 158 of second object 132.

For example, without limitation, the portion of outer nozzle shape 136 belonging to fairing element 137 may have a cross-sectional shape that takes the form of curved shape 138. Curved shape 138 may be used to fair exposed surface 133 of fillet 140 at interface 126 before fluid 110 solidifies or becomes unworkable. In other words, curved shape 138 may be used to smooth and round out exposed surface 133 of fillet 140 at interface 126 before fluid 110 solidifies or becomes unworkable.

Curved shape 138 may be implemented using a number of different shapes. Curved shape 138 may be comprised of any number of different radii of curvature. Curved shape 138 may be implemented comprising at least one of spherical shape 142, convex shape 144, concave shape 146, semi-spherical shape 147, or some other type of curved shape. Convex shape 144 and concave shape 146 may be with respect to opening 115. The size of spherical shape 142 may determine the thickness of the deposition of fluid 110 at interface 126.

Nozzle 108 may be moved along interface 126 such that the cross-sectional shape of exposed surface 133 of fillet 140 substantially conforms to curved shape 138 of nozzle 108. In this manner, depending on the implementation of curved shape 138, exposed surface 133 of fillet 140 may be reshaped to have desired cross-sectional shape 145 that is one of a convex shape, a concave shape, or some other type of shape.

The size of curved shape 138 may be selected based on a number of different factors. The size of curved shape 138 may be selected based on, for example, without limitation, at least one of a size or a shape of interface 126. For example, without limitation, a cross-sectional diameter of curved shape 138 may be selected such that fairing element 137 does or does not come into contact with first surface 156 of first object 130 and/or second surface 158 of second object 132 as nozzle 108 is moved along interface 126. In some cases, the cross-sectional diameter of curved shape 138 may be selected based on the angle between first surface 156 and second surface 158.

Curved shape 138 may allow exposed surface 133 of fillet 140 to be faired just after fluid 110 has been deposited such that desired cross-sectional shape 145 for exposed surface 133 of fillet 140 may be achieved in the same movement or pass of nozzle 108 along interface 126. In other words, nozzle 108 may not need to be moved along the same portion of interface 126 again in order to achieve desired cross-sectional shape 145 for exposed surface 133. Further, no other tools may be needed to work fillet 140 to achieve desired cross-sectional shape 145 for exposed surface 133.

Depending on the implementation, curved shape 138 may be selected such that curved shape 138 has a transitional effect on fillet 140 such that the cross-sectional shape of exposed surface 133 of fillet 140 is gradually transformed into desired cross sectional shape 145. However, this gradual transformation may still occur within the same pass of nozzle 108 moving along interface 126.

In some illustrative examples, fairing element 137 may be detachable from the rest of nozzle 108. For example, without limitation, fairing element 137 may be a separate component configured for attachment to and/or detachment from the rest of nozzle 108. When fairing element 137 takes the form of this type of separate component, fairing element 137 may have exit 139 that coincides with opening 115 such that fluid 110 flows through opening 115 and exit 139. Exit 139 may have a same or different cross-sectional diameter compared to cross-sectional diameter 117 as opening 115.

As depicted, opening 115 in nozzle 108 may have position 150 with respect to curved shape 138. Position 150 of opening 115 with respect to curved shape 138 may be selected to improve the precision and accuracy with which fillet 140 may be formed. In one illustrative example, opening 115 may be positioned such that position 150 of opening 115 lies along center axis 152 of structure 105. However, in another illustrative example, position 150 of opening 115 may be selected offset from center axis 152. In this manner, position 150 of opening 115 may be one of on-center and off-center relative to center axis 152.

For example, without limitation, position 150 may be selected such that fluid 110 exits opening 115 in the direction of travel for nozzle 108. Position 150 may be selected such that the dispensing of fluid 110 through opening 115 is more easily automated. In some cases, position 150 may be selected such that fairing of fillet 140 formed by fluid 110 is more easily and accurately performed to achieve desired cross-sectional shape 145 for fillet 140.

In some illustrative examples, when nozzle 108 is a separate component attached to structure 105, nozzle 108 may be configured to move relative to structure 105. In particular, nozzle 108 may be configured to move relative to structure 105 in a direction along center axis 152. Nozzle 108 may be moveable relative to structure 105 such that nozzle 108 may be configured to maintain contact with fillet 140 as nozzle 108 is moved along interface 126. In this manner, nozzle 108 may be able to account for small undulations in first surface 156 of first object 130 and/or second surface 158 of second object 132 that may not be taken into account by the movement system (not shown) being used to move nozzle 108 along interface 126.

In one illustrative example, nozzle 108 may be configured to move using biasing element 154. Biasing element 154 may be associated with at least one of structure 105 and nozzle 108. In one illustrative example, biasing element 154 may take the form of a mechanical spring that may allow nozzle 108 to move relative to structure 105 to accommodate variations in first surface 156 of first object 130 and/or second surface 158 of second object 132 forming interface 126. Biasing element 154 may provide a force that allows a minimal contact pressure to be maintained with fillet 140 as nozzle 108 is moved along interface 126 such that undesired out-of-tolerance inconsistencies are not formed at exposed surface 133 of fillet 140, first surface 156 of first object 130, and/or second surface 158 of second object 132 as nozzle 108 is moved along interface 126.

In another illustrative example, nozzle 108 may be configured to move using fluid pressure 160. In particular, nozzle 108 may have fluid chamber 162 configured to create fluid pressure 160. Fluid chamber 162 may be located between opening 115 and end 161 of structure 105 to which nozzle 108 may be attached.

Fluid chamber 162 may be configured to hold fluid 110 within nozzle 108. Fluid chamber 162 may have a larger cross-sectional area than opening 115 of nozzle 108. In other words, fluid chamber 162 may have cross-sectional diameter 164 that may be greater than cross-sectional diameter 117 of opening 115 of nozzle 108.

Consequently, fluid pressure 160 of fluid 110 may be higher within fluid chamber 162 than within opening 115 when the flow of fluid 110 into fluid chamber 162 is greater than the flow of fluid 110 out of fluid chamber 162. In other words, fluid pressure 160 of fluid 110 may be higher within fluid chamber 162 than within opening 115 when the velocity of fluid 110 flowing into fluid chamber 162 is greater than the velocity of fluid 110 flowing out of fluid chamber 162. The flow of fluid 110 may be affected by viscosity 118 of fluid 110. The difference in fluid pressure 160 between fluid chamber 162 and opening 115 may result in movement of fluid 110 that is similar to the movement of a piston within a cylinder.

In one illustrative example, fluid chamber 162 may be formed from a material or coated in a material configured to make the flow of fluid 110 having viscosity 118 above range 120 through fluid chamber 162 easier.

In some cases, some type of control or feedback control may be used to control at least one of a rate or an amount of fluid 110 being dispensed from nozzle 108 such that fairing element 137 is able to work exposed surface 133 of fillet 140 to have desired cross-sectional shape 145. Further, with this type of control, fillet 140 having desired cross-sectional shape 145 along the length of fillet 140 may be formed with minimal waste of fluid 110.

The illustration of manufacturing environment 100 and fluid dispensing system 102 with nozzle 108 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, without limitation, fluid source 104 may be considered separate from fluid dispensing system 102. In some illustrative examples, one or more components of structure 105 and/or nozzle 108 may be disposable parts that may be detached from fluid source 104 and discarded after use.

In other illustrative examples, structure 105 may be considered part of fluid source 104. For example, without limitation, in these examples, structure 105 may be formed as part of fluid source 104.

Figure 2:
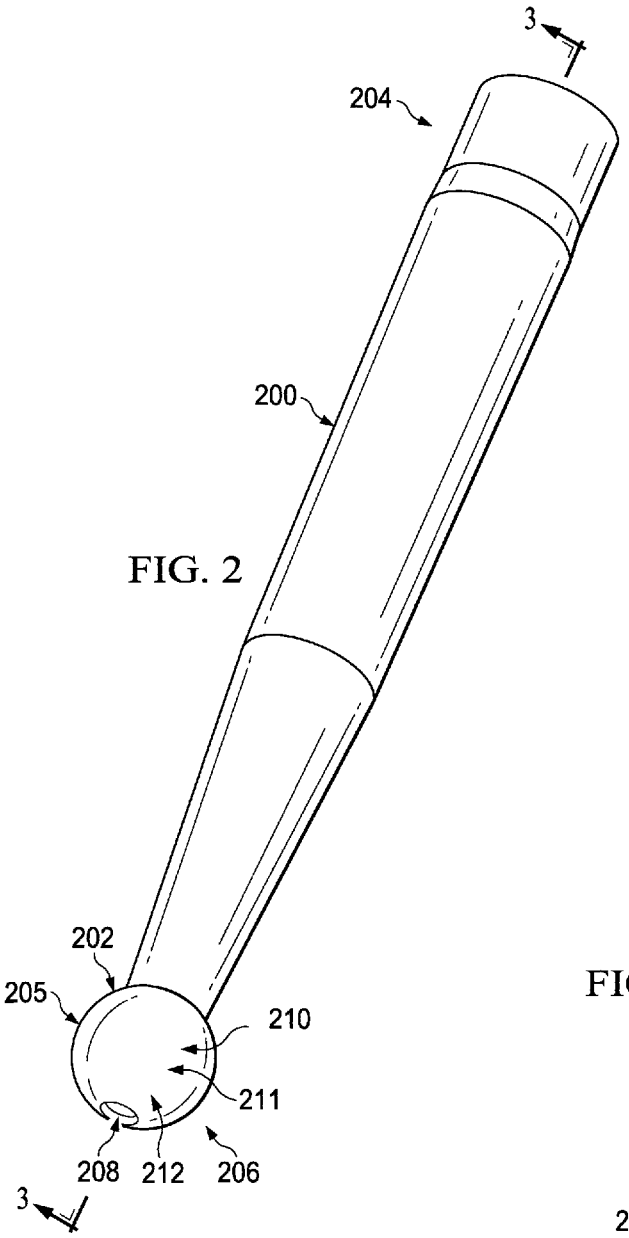
FIG. 2 is an illustration of an isometric view of a structure and a nozzle associated with the structure in accordance with an illustrative embodiment.

With reference now to FIG. 2, an illustration of an isometric view of a structure and a nozzle associated with the structure is depicted in accordance with an illustrative embodiment. In this illustrative example, structure 200 and nozzle 202 may be examples of implementations for structure 105 and nozzle 108, respectively, in FIG. 1.

Structure 200 may have first end 204 and second end 206. First end 204 may be configured for attachment to a fluid source (not shown). Nozzle 202 may be associated with second end 206 of structure 200. In particular, in this illustrative example, nozzle 202 may be formed as part of structure 200 at second end 206 of structure 200.

Further, nozzle 202 may include fairing element 205. Fairing element 205 may be an example of one implementation for fairing element 137 in FIG. 1.

As depicted, nozzle 202 may have opening 208 through which fluid (not shown) may be allowed to exit nozzle 202. Opening 208 may be an example of one implementation for opening 115 in FIG. 1.

Further, nozzle 202 may have outer nozzle shape 210. Outer nozzle shape 210 may be an example of one implementation for outer nozzle shape 136 in FIG. 1. In this illustrative example, outer nozzle shape 210 may include curved shape 211. Curved shape 211 may be the portion of outer nozzle shape 210 belonging to fairing element 205. Curved shape 211 may be an example of one implementation for curved shape 138 in FIG. 1. In this illustrative example, curved shape 211 is implemented as spherical shape 212 with respect to opening 208. In other words, the portion of outer nozzle shape 210 surrounding opening 208 may be spherical.

Spherical shape 212 may be an example of one implementation for spherical shape 142 in FIG. 1. Spherical shape 212 may be used to smooth and round out, or fair, the fluid (not shown) that is dispensed through nozzle 202.

Figure 3:
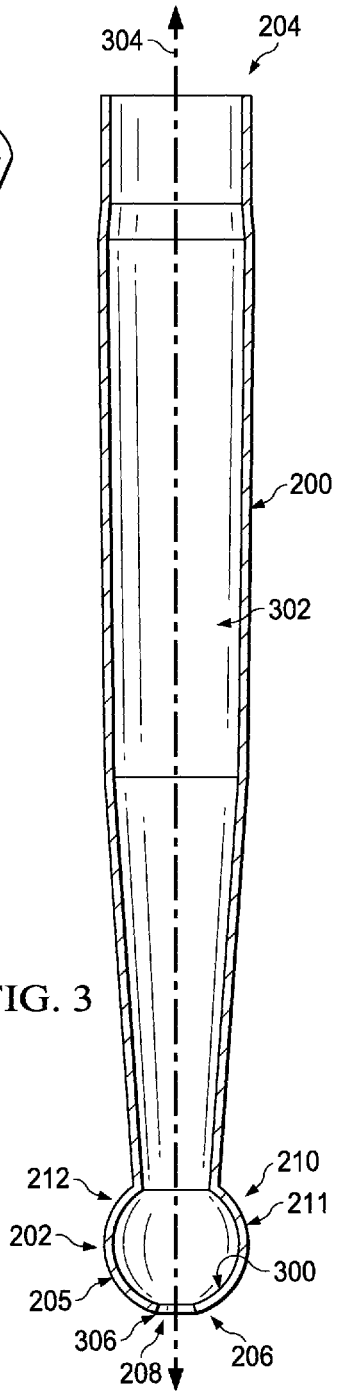
FIG. 3 is an illustration a cross-sectional view of a structure and a nozzle in accordance with an illustrative embodiment.

With reference now to FIG. 3, an illustration of a cross-sectional view of structure 200 and nozzle 202 from FIG. 2 is depicted in accordance with an illustrative embodiment. In this illustrative example, a cross-sectional view of structure 200 and nozzle 202 from FIG. 2 is depicted taken with respect to lines 3-3 in FIG. 2. As depicted, lines 3-3 bisect structure 200 and nozzle 202 from FIG. 2. Inner nozzle shape 300 of nozzle 202 may be seen in this illustrative example.

Fluid (not shown) may flow through channel 302 formed by structure 200 and nozzle 202 and may exit nozzle 202 through opening 208. In this illustrative example, opening 208 may have position 306, which may be on-center relative to center axis 304 of structure 200. In this manner, the fluid (not shown) may exit opening 208 in a same direction as the direction in which the fluid (not shown) may flow through channel 302.

Figure 4:
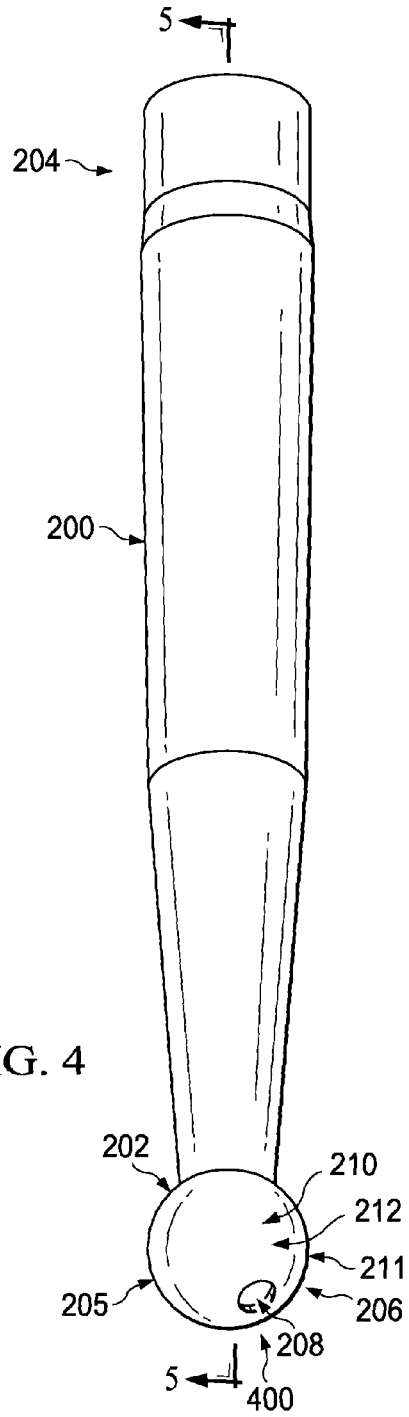
FIG. 4 is an illustration of an opening in a nozzle having a different position relative to a center axis of a structure in accordance with an illustrative embodiment.

Turning now to FIG. 4, an illustration of opening 208 in nozzle 202 from FIGS. 2-3 having a different position relative to center axis 304 of structure 200 is depicted in accordance with an illustrative embodiment. In this illustrative example, opening 208 may have position 400, which may be off-center relative to center axis 304 (not shown) in FIG. 3 of structure 200. In this manner, fluid (not shown) may exit opening 208 in a direction angled with respect to the direction in which the fluid (not shown) may flow through channel 302.

Figure 5:
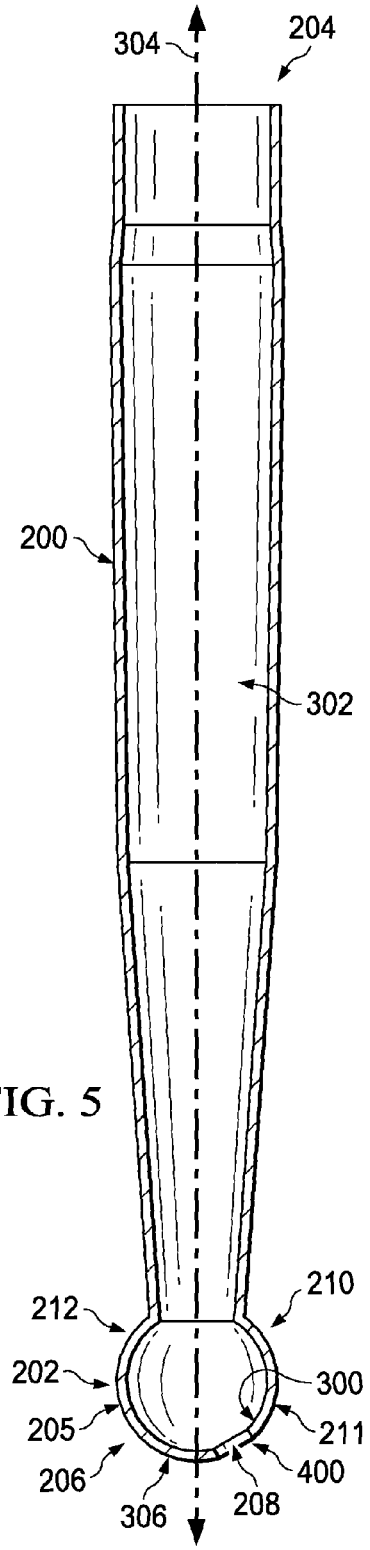
FIG. 5 is an illustration of a cross-sectional view of a structure and a nozzle in accordance with an illustrative embodiment.

With reference now to FIG. 5, an illustration of a cross-sectional view of structure 200 and nozzle 202 from FIG. 4 is depicted in accordance with an illustrative embodiment. In this illustrative example, a cross-sectional view of structure 200 and nozzle 202 from FIG. 4 with opening 208 off-center relative to center axis 304 of structure 200 is depicted taken with respect to lines 5-5 in FIG. 4. As depicted, lines 5-5 bisect structure 200 and nozzle 202 from FIG. 4.

Figure 6:
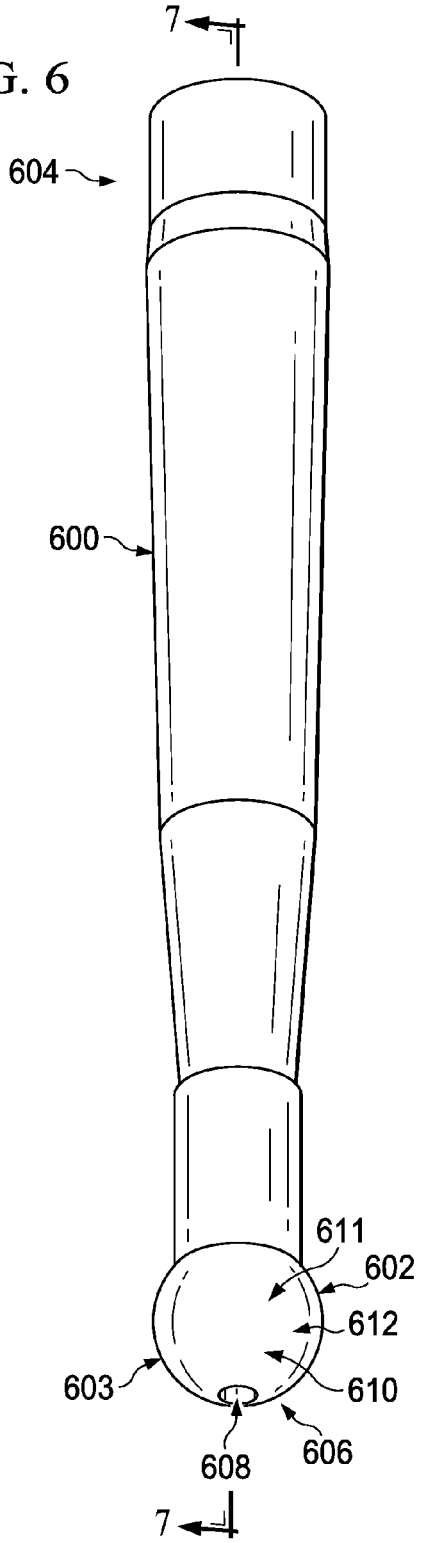
FIG. 6 is an illustration of a nozzle attached to a structure in accordance with an illustrative embodiment.

With reference now to FIG. 6, an illustration of a nozzle attached to a structure is depicted in accordance with an illustrative embodiment. In this illustrative example, structure 600 and nozzle 602 may be examples of implementations for structure 105 and nozzle 108, respectively, in FIG. 1.

As depicted, structure 600 may have first end 604 and second end 606. First end 604 may be configured for attachment to a fluid source (not shown). Nozzle 602 may be attached to second end 606 of structure 600. In particular, in this illustrative example, nozzle 602 may be a separate component attached to second end 606 of structure 600.

Nozzle 602 may include fairing element 603. Fairing element 603 may be an example of one implementation for fairing element 137 in FIG. 3. Further, as depicted, nozzle 602 may have opening 608 through which fluid (not shown) may be allowed to exit nozzle 602. Opening 608 may be an example of one implementation for opening 115 in FIG. 1.

Further, nozzle 602 may have outer nozzle shape 610. Outer nozzle shape 610 may be an example of one implementation for outer nozzle shape 136 in FIG. 1. The portion of outer nozzle shape 610 belonging to fairing element 603 may take the form of curved shape 611.

Curved shape 611 may be an example of one implementation for curved shape 138 in FIG. 1. In particular, curved shape 611 may be implemented as spherical shape 612 with respect to opening 608 in this illustrative example. In other words, the portion of outer nozzle shape 610 surrounding opening 608 may be spherical.

Spherical shape 612 may be an example of one implementation for spherical shape 142 in FIG. 1. Spherical shape 612 may be used to smooth and round out, or fair, the fluid (not shown) that is dispensed through nozzle 602.

Figure 7:
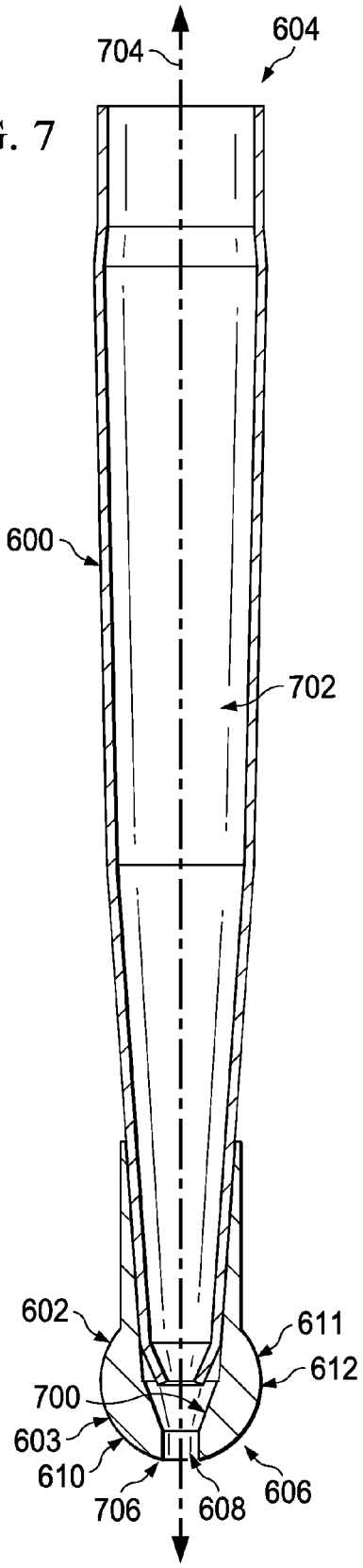
FIG. 7 is an illustration of a cross-sectional view of a structure and a nozzle in accordance with an illustrative embodiment.

With reference now to FIG. 7, an illustration of a cross-sectional view of structure 600 and nozzle 602 from FIG. 6 is depicted in accordance with an illustrative embodiment. In this illustrative example, a cross-sectional view of structure 600 and nozzle 602 from FIG. 6 is depicted taken with respect to lines 7-7 in FIG. 6. As depicted, lines 7-7 bisect structure 600 and nozzle 602 from FIG. 6. Inner nozzle shape 700 of nozzle 602 may be seen in this illustrative example.

Fluid (not shown) may flow through channel 702 formed by structure 600 and nozzle 602 and may exit nozzle 602 through opening 608. In this illustrative example, opening 608 may have position 706, which may be on-center relative to center axis 704 of structure 600. In this manner, the fluid (not shown) may exit opening 608 in a same direction as the direction in which the fluid (not shown) may flow through channel 702.

Figure 8:
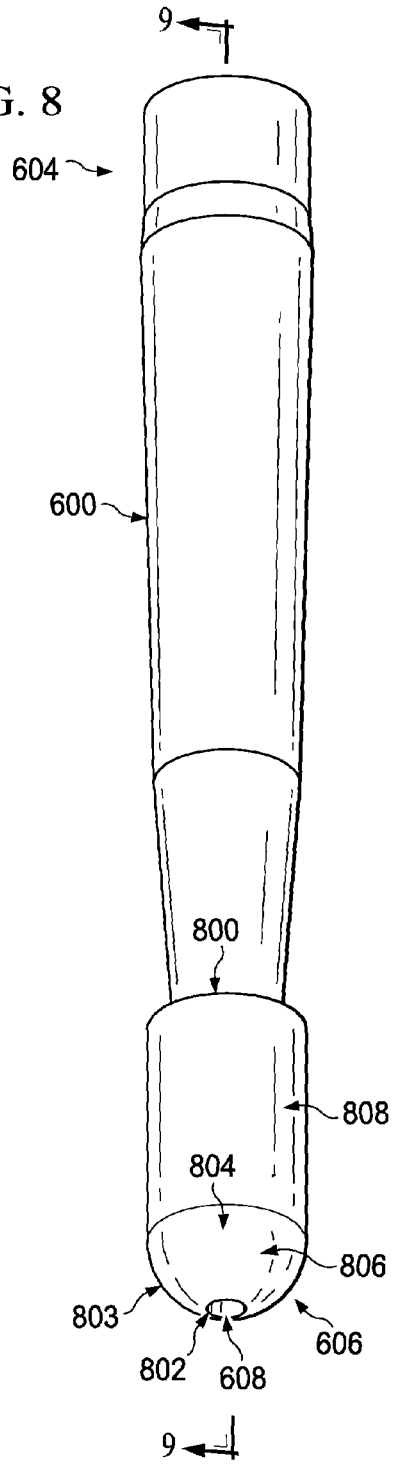
FIG. 8 is an illustration of a different type of nozzle attached to a structure in accordance with an illustrative embodiment.

With reference now to FIG. 8, an illustration of a different type of nozzle attached to structure 600 from FIGS. 6-7 is depicted in accordance with an illustrative embodiment. In this illustrative example, nozzle 800 may be another example of one implementation for nozzle 108 in FIG. 1. Nozzle 800 may have opening 802 through which fluid (not shown) may exit.

Further, as depicted, nozzle 800 may have fairing element 803. Fairing element 803 may be an example of one implementation for fairing element 137 in FIG. 3. Nozzle 800 may also have outer nozzle shape 804. Outer nozzle shape 804 may be an example of one implementation for outer nozzle shape 136 in FIG. 1.

The portion of outer nozzle shape 804 that belongs to fairing element 803 may take the form of semi-spherical shape 806. Semi-spherical shape 806 may be an example of one implementation for semi-spherical shape 147 in FIG. 1. Semi-spherical shape 806 of fairing element 803 may be used for fairing.

Figure 9:
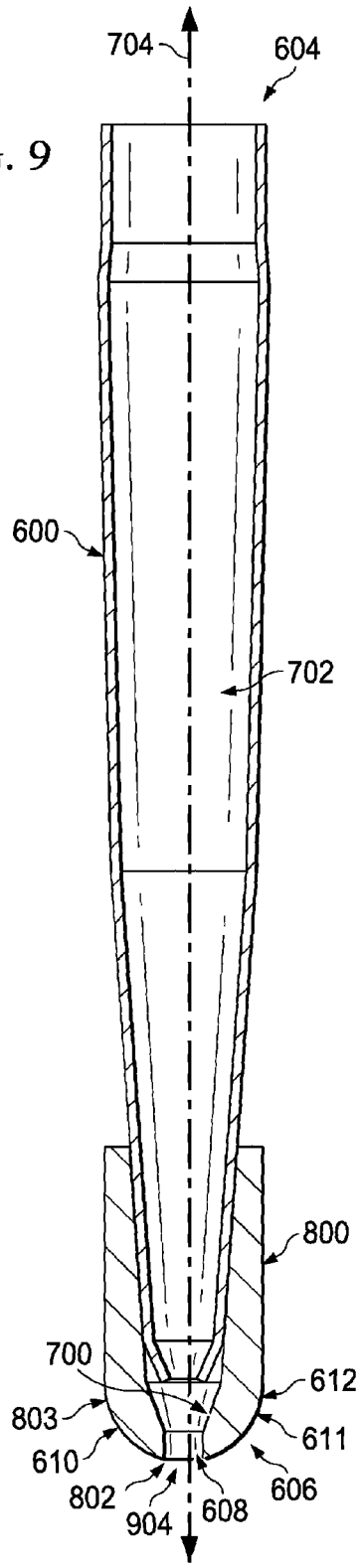
FIG. 9 is an illustration of a cross-sectional view of a structure and a nozzle in accordance with an illustrative embodiment.

Turning now to FIG. 9, an illustration of a cross-sectional view of structure 600 and nozzle 800 from FIG. 8 is depicted in accordance with an illustrative embodiment. In this illustrative example, a cross-sectional view of structure 600 and nozzle 800 is depicted taken with respect to lines 9-9 in FIG. 8. As depicted, lines 9-9 bisect structure 600 and nozzle 800 from FIG. 8. Inner nozzle shape 900 of nozzle 800 may be seen in this illustrative example.

Fluid (not shown) may flow through channel 702 formed by structure 600 and nozzle 800 and may exit nozzle 800 through opening 802. In this illustrative example, opening 802 may have position 904, which may be on-center relative to center axis 704 of structure 600. In this manner, the fluid (not shown) may exit opening 802 in a same direction as the direction in which the fluid (not shown) may flow through channel 702.

Figure 10:
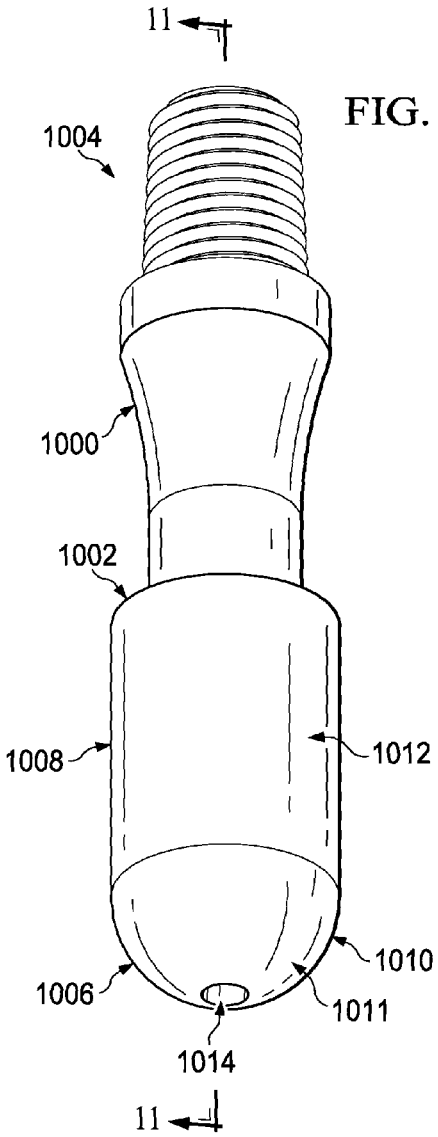
FIG. 10 is an illustration of a structure with a nozzle attached to the structure in accordance with an illustrative embodiment.

With reference now to FIG. 10, an illustration of a structure with a nozzle attached to the structure is depicted in accordance with an illustrative embodiment. In this illustrative example, structure 1000 and nozzle 1002 may be examples of implementations for structure 105 and nozzle 108, respectively, in FIG. 1.

As depicted, structure 1000 may have attachment feature 1004 configured for use in attaching structure 1000 to a fluid source (not shown). Fluid (not shown) from the fluid source (not shown) may flow through structure 1000 and through nozzle 1002.

In this illustrative example, nozzle 1002 may have fairing element 1006. Fairing element 1006 may be an example of one implementation for fairing element 137 in FIG. 1. As depicted, nozzle 1002 may have outer nozzle shape 1008. Outer nozzle shape 1008 may be an example of one implementation for outer nozzle shape 136 in FIG. 1. As depicted, the portion of outer nozzle shape 1008 belonging to fairing element 1006 may take the form of semi-spherical shape 1011. Semi-spherical shape 1011 may be an example of one implementation for semi-spherical shape 147 in FIG. 1. Fluid (not shown) may be dispensed through opening 1014 of nozzle 1002 and applied to an interface (not shown), while being concurrently faired using semi-spherical shape 1011.

Figure 11:
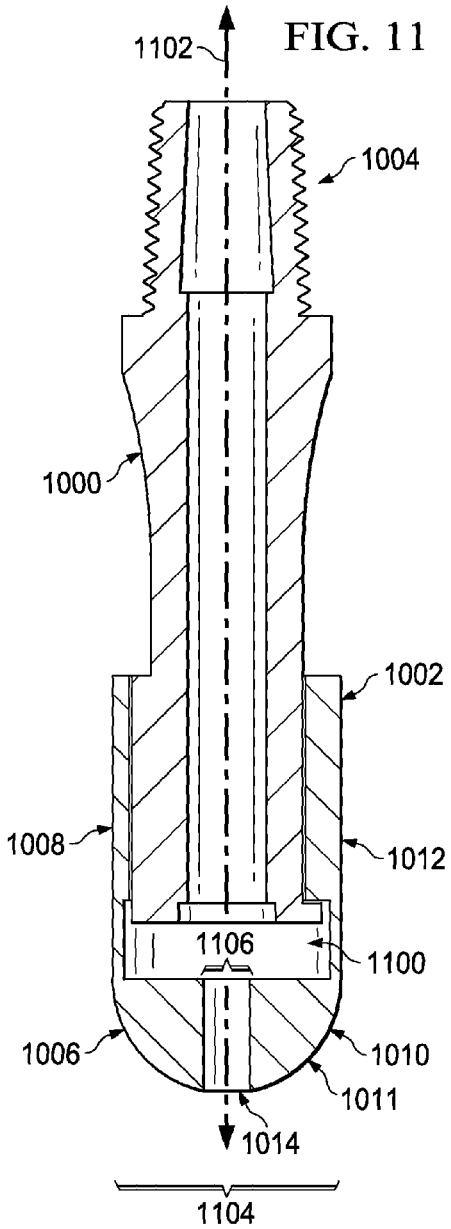
FIG. 11 is an illustration of a cross-sectional view of a structure and a nozzle in accordance with an illustrative embodiment.

Turning now to FIG. 11, an illustration of a cross-sectional view of structure 1000 and nozzle 1002 from FIG. 10 is depicted in accordance with an illustrative embodiment. In this illustrative example, a cross-sectional view of structure 1000 and nozzle 1002 from FIG. 10 may be depicted with respect to lines 11-11 in FIG. 10. As depicted, lines 11-11 bisect structure 1000 and nozzle 1002 from FIG. 10.

As depicted, nozzle 1002 may have fluid chamber 1100. Fluid chamber 1100 may be configured to create a fluid pressure that allows nozzle 1002 to move relative to structure 1000 in a direction along center axis 1102 of structure 1000. In particular, fluid chamber 1100 may be configured to hold fluid (not shown) that flows through structure 1000 into nozzle 1002. Fluid chamber 1100 may have diameter 1104 that may be greater than diameter 1106 of opening 1014. This difference between diameter 1104 and diameter 1106 may create a fluid pressure that allows the fluid (not shown) within fluid chamber 1100 to function as a biasing element, such as, for example, without limitation, a damper, or a spring.

Figure 12:
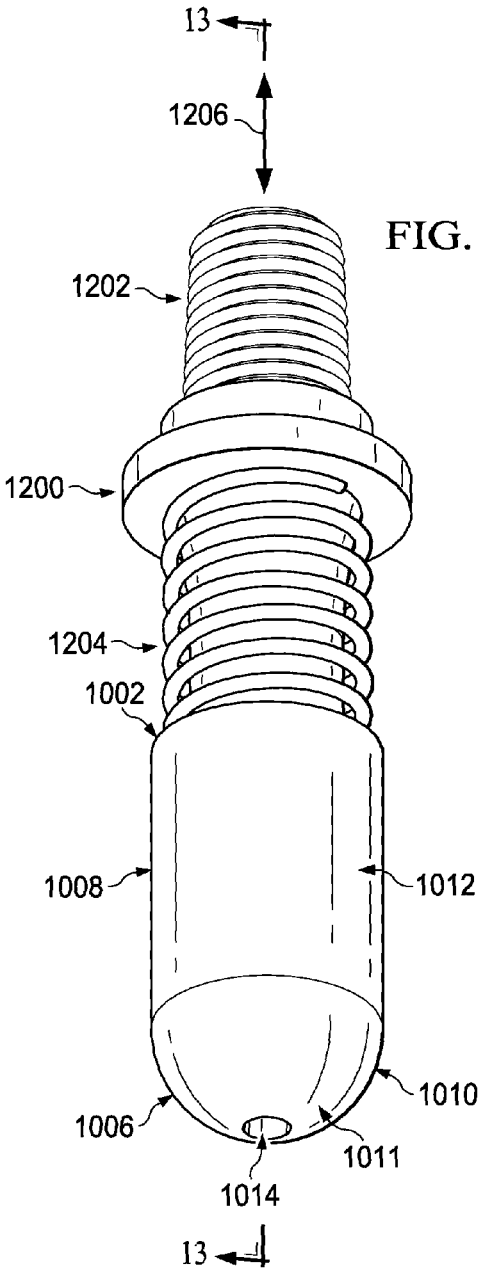
FIG. 12 is an illustration of a nozzle attached to a different type of structure in accordance with an illustrative embodiment.

With reference now to FIG. 12, an illustration of nozzle 1002 attached to a different type of structure is depicted in accordance with an illustrative embodiment. In this illustrative example, structure 1200 may be another example of one implementation for structure 105 in FIG. 1. In this example, nozzle 1002 is attached to structure 1200.

As depicted, structure 1200 may have attachment feature 1202 configured for use in attaching structure 1200 to a fluid source (not shown). Further, structure 1200 may have biasing element 1204 associated with structure 1200. Biasing element 1204 may be configured to allow biased movement of nozzle 1002 relative to structure 1200 in a direction along center axis 1206 of structure 1200. In this illustrative example, biasing element 1204 may take the form of a spring. Of course, in other illustrative examples, biasing element 1204 may take some other form.

Figure 13:
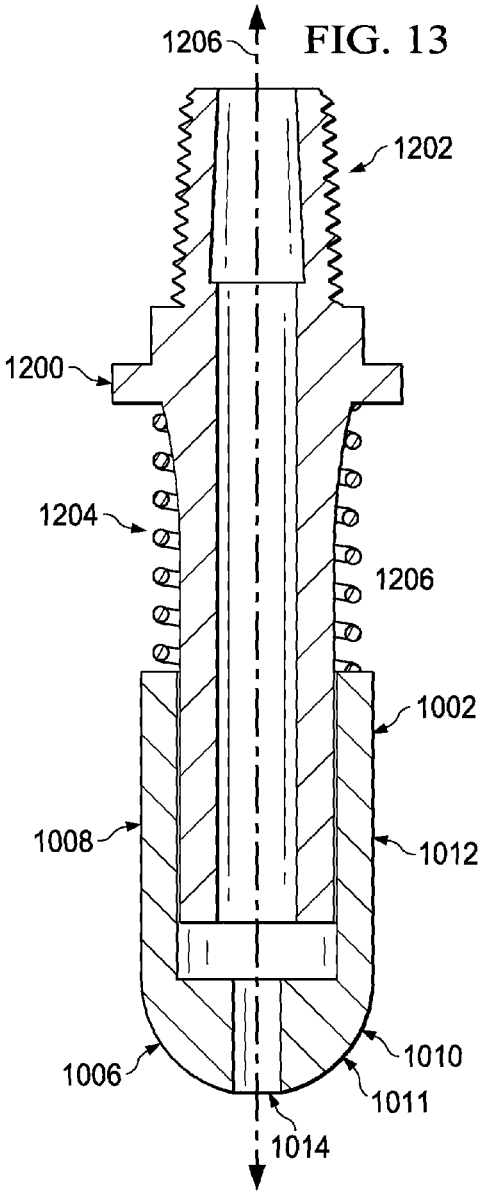
FIG. 13 is an illustration of a cross-sectional view of a structure and a nozzle in accordance with an illustrative embodiment.

Turning now to FIG. 13, an illustration of a cross-sectional view of structure 1200 and nozzle 1002 from FIG. 12 is depicted in accordance with an illustrative embodiment. In this illustrative example, a cross-sectional view of structure 1200 and nozzle 1002 may be depicted with respect to lines 13-13 in FIG. 12. As depicted, lines 13-13 bisect structure 1200 and nozzle 1002 from FIG. 12.

Figure 14:
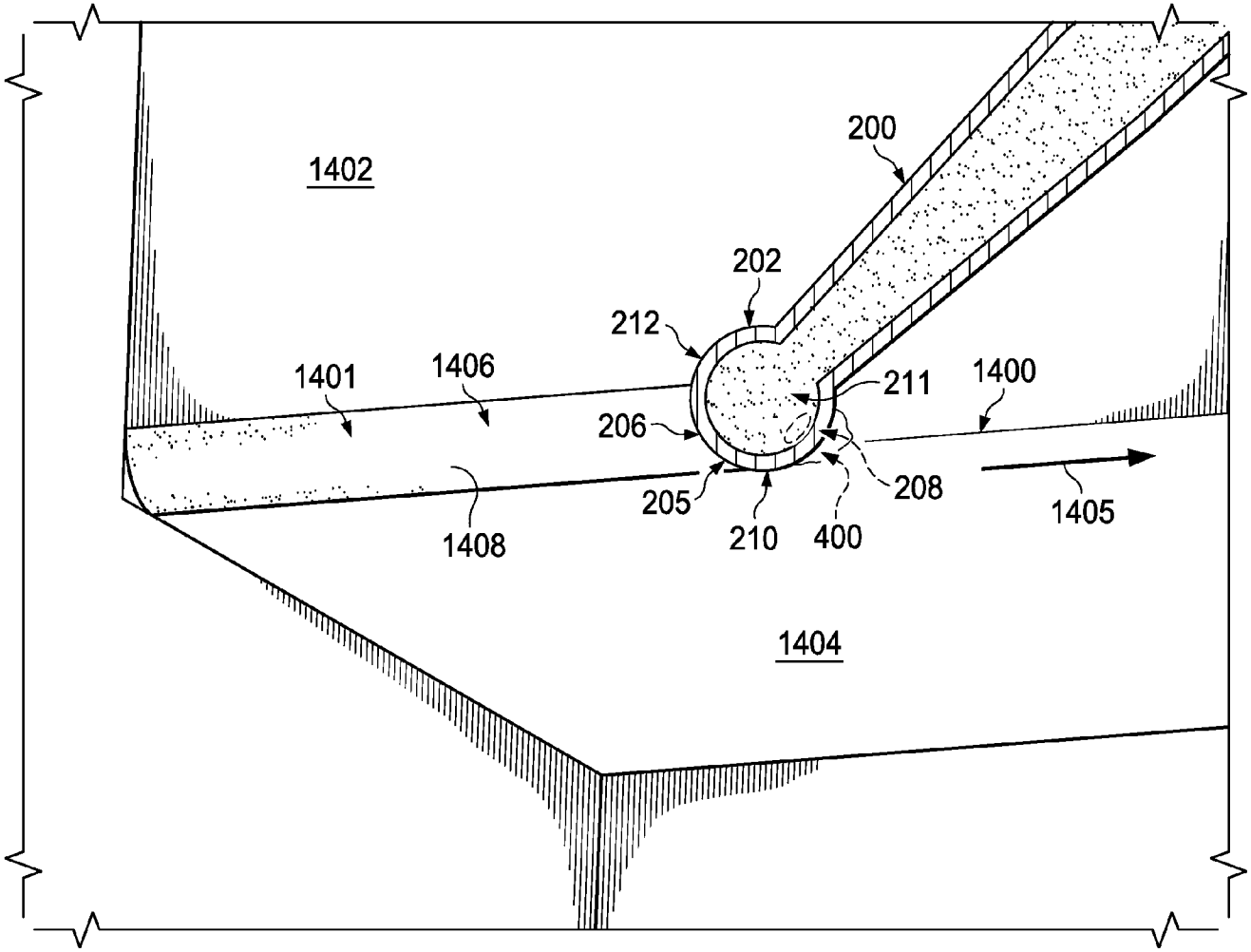
FIG. 14 is an illustration of a cross-sectional view of a structure and a nozzle being used to apply a fluid to an interface in accordance with an illustrative embodiment.

With reference now to FIG. 14, an illustration of a cross-sectional view of structure 200 and nozzle 202 from FIGS. 4-5 being used to apply a fluid to an interface is depicted in accordance with an illustrative embodiment. In this illustrative example, a cross-sectional view of structure 200 and nozzle 202 is depicted taken with respect to lines 5-5 in FIG. 4. Nozzle 202 from FIGS. 4-5 may be used to dispense and apply fluid 1401 to interface 1400 to form fillet 1406 in this illustrative example.

Interface 1400 may take the form of a corner formed between first part 1402 and second part 1404. Interface 1400 may be an example of one implementation for interface 126, and interior corner 128 in particular, in FIG. 1. Further, fillet 1406 may be an example of one implementation for fillet 140 in FIG. 1.

As depicted, spherical shape 212 of nozzle 202 may allow nozzle 202 to fair fillet 1406 while nozzle 202 is being moved in the direction of arrow 1405 and fluid 1401 is being dispensed from nozzle 202 all within a single pass. In particular, spherical shape 212 of nozzle 202 may be used to fair fillet 1406 such that exposed surface 1408 of fillet 1406 may have a desired cross-sectional shape, such as desired cross-sectional shape 145 in FIG. 1.

Spherical shape 212 of nozzle 202 and position 400 of opening 208 of nozzle 202 may allow exposed surface 1408 to be faired to achieve the desired cross-sectional shape without requiring any additional passes of nozzle 202 along interface 1400. In other words, nozzle 202 may not need to be moved along interface 1400 again. Further, no other tools may be needed to rework fillet 1406 in order to achieve the desired cross-sectional shape for exposed surface 1408.

Figure 15:
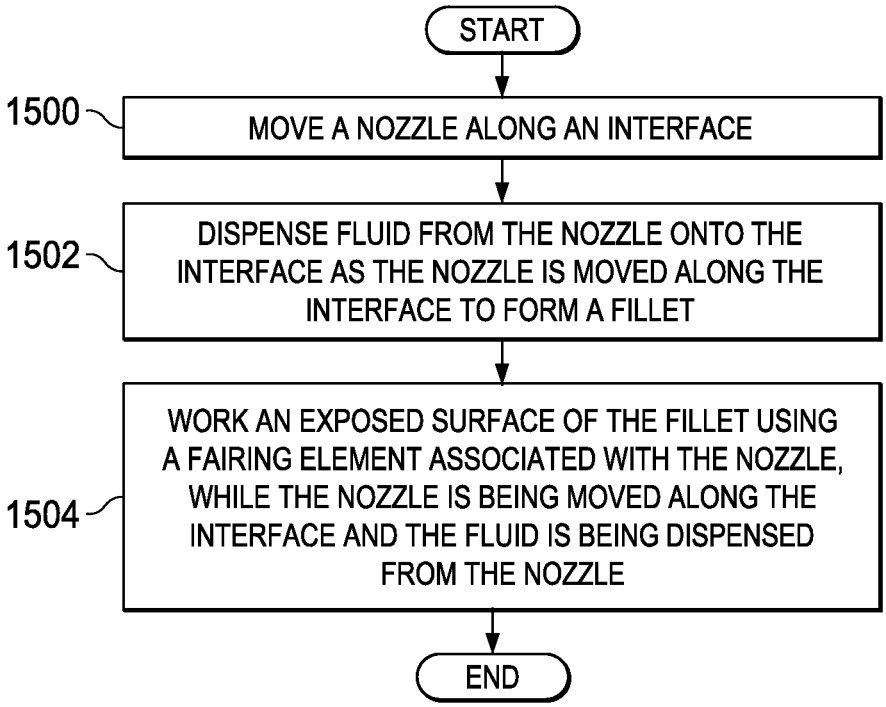
FIG. 15 is an illustration of a process for forming and working a fillet in the form of a flowchart in accordance with an illustrative embodiment.

With reference now to FIG. 15, an illustration of a process for forming and working a fillet is depicted in the form of a flowchart in accordance with an illustrative embodiment. The process illustrated in FIG. 15 may be implemented using, for example, without limitation, nozzle 108 of fluid dispensing system 102 in FIG. 1.

The process may begin by moving nozzle 108 along interface 126 (operation 1500). Next, fluid 110 may be dispensed from nozzle 108 onto interface 126 as nozzle 108 is moved along interface 126 to form fillet 140 (operation 1502). Further, exposed surface 133 of fillet 140 may be worked using fairing element 137 associated with nozzle 108, while nozzle 108 is being moved along interface 126 and fluid 110 is being dispensed from nozzle 108, (operation 1504), with the process terminating thereafter.

In operation 1504, fairing element 137 is used to work exposed surface 133 of fillet 140 such that a cross-sectional shape of exposed surface 133 of fillet 140 may take on desired cross-sectional shape 145. The process described in FIG. 15 may be performed in a single pass of nozzle 108 concurrently moving along interface 126 and dispensing fluid 110 onto interface 126 moving such that exposed surface 133 of fillet 140 has desired cross-sectional shape 145.

Figure 16:
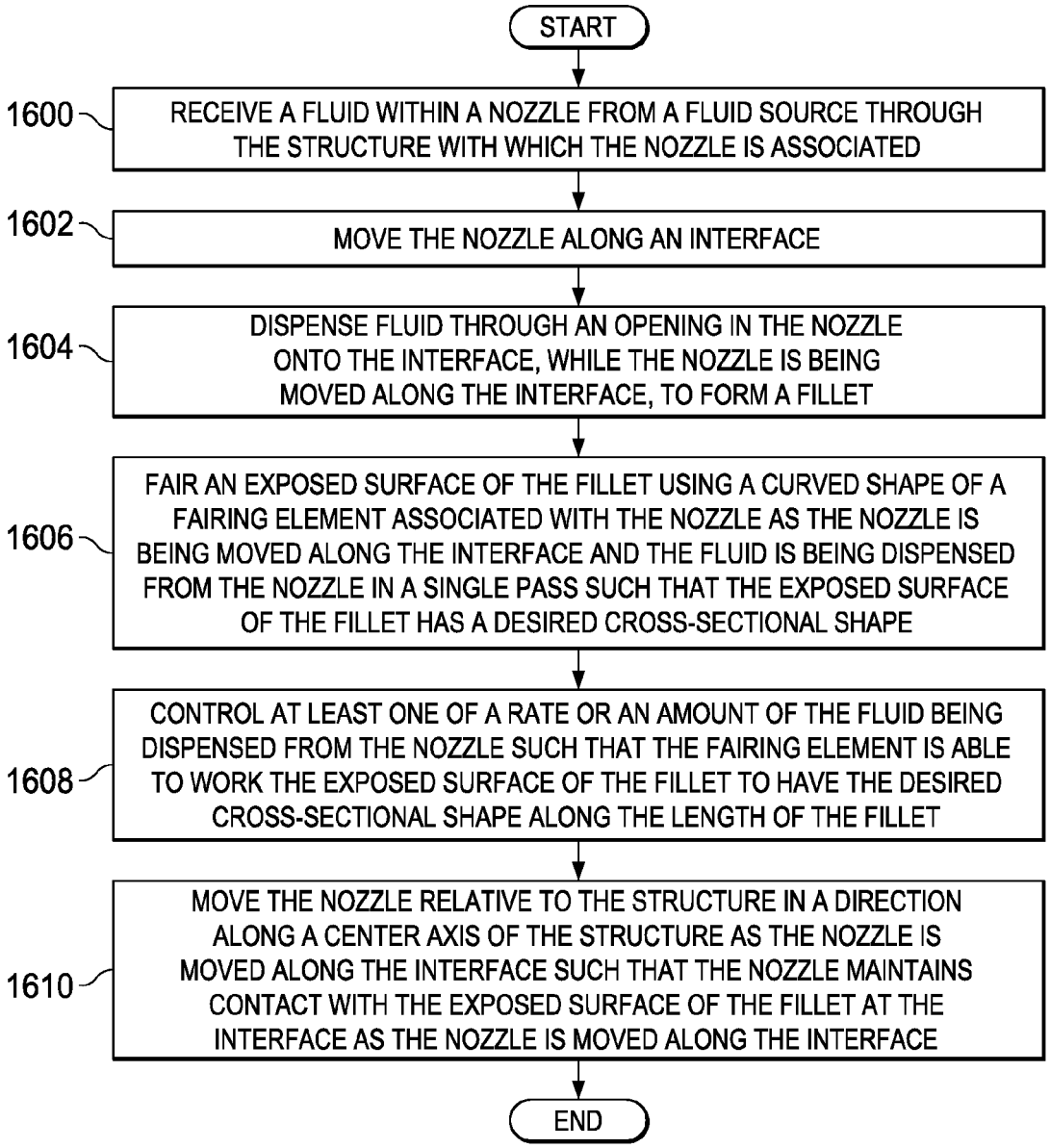
FIG. 16 is an illustration of a process for concurrently forming and fairing a fillet at an interface in the form of a flowchart in accordance with an illustrative embodiment.

With reference now to FIG. 16, an illustration of a process for concurrently forming and fairing a fillet at an interface is depicted in the form of a flowchart in accordance with an illustrative embodiment. The process illustrated in FIG. 16 may be implemented using, for example, without limitation, nozzle 108 of fluid dispensing system 102 in FIG. 1.

The process may begin by receiving fluid 110 within nozzle 108 from fluid source 104 through structure 105 with which nozzle 108 is associated (operation 1600). Next, nozzle 108 may be moved along interface 126 (operation 1602).

Fluid 110 may be dispensed through opening 115 in nozzle 108 onto interface 126, while nozzle 108 is being moved along interface 126, to form fillet 140 (operation 1604). Exposed surface 133 of fillet 140 may be faired using curved shape 138 of fairing element 137 associated with nozzle 108 as nozzle 108 is being moved along interface 126 and fluid 110 is being dispensed from nozzle 108 in a single pass such that exposed surface 133 of fillet 140 has desired cross-sectional shape 145 (operation 1606). Curved shape 138 may comprise at least one of spherical shape 142, convex shape 144, concave shape 146, and semi-spherical shape 147.

At least one of a rate or an amount of fluid 110 being dispensed from nozzle 108 may be controlled such that fairing element 137 is able to work exposed surface 133 of fillet 140 to have desired cross-sectional shape 145 along the length of fillet 140 (operation 1608). Operation 1608 may be performed to ensure that only a single pass of nozzle 108 moving along interface 126 is needed to form fillet 140 and sufficiently work fillet 140 such that exposed surface 133 of fillet 140 has desired cross-sectional shape 145. Further, operation 1608 may be performed to reduce the amount of fluid 110 wasted during the fillet-forming and fairing process.

Further, nozzle 108 may be moved relative to structure 105 in a direction along center axis 152 of structure 105 as nozzle 108 is moved along interface 126 such that nozzle 108 maintains contact with exposed surface 133 of fillet 140 at interface 126 as nozzle 108 is moved along interface 126 (operation 1610), with the process terminating thereafter. In operation 1610, one of biasing element 154 and fluid pressure 160 created by fluid chamber 162 located between opening 115 in nozzle 108 and end 161 of structure 105 may be used to allow nozzle 108 to move relative to structure 105 in a direction along center axis 152.

Figure 17:
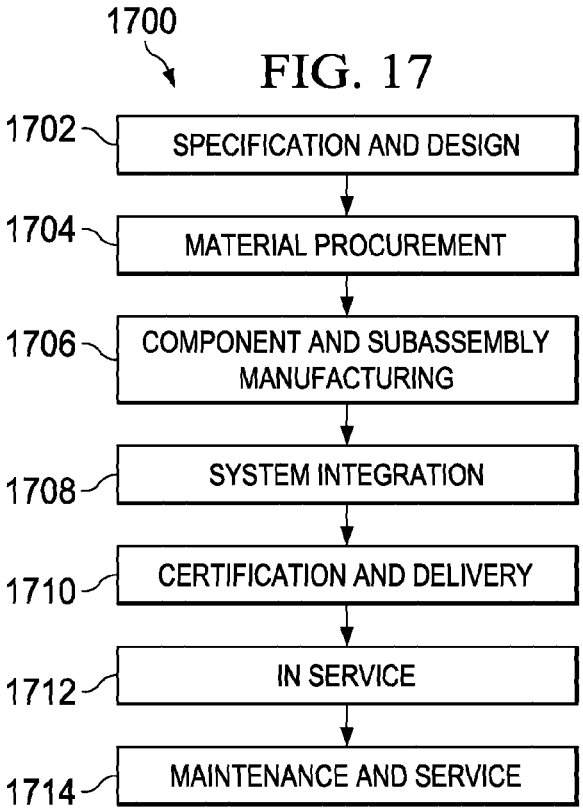
FIG. 17 is an illustration of an aircraft manufacturing and service method in the form of a flowchart in accordance with an illustrative embodiment.
Figure 18:
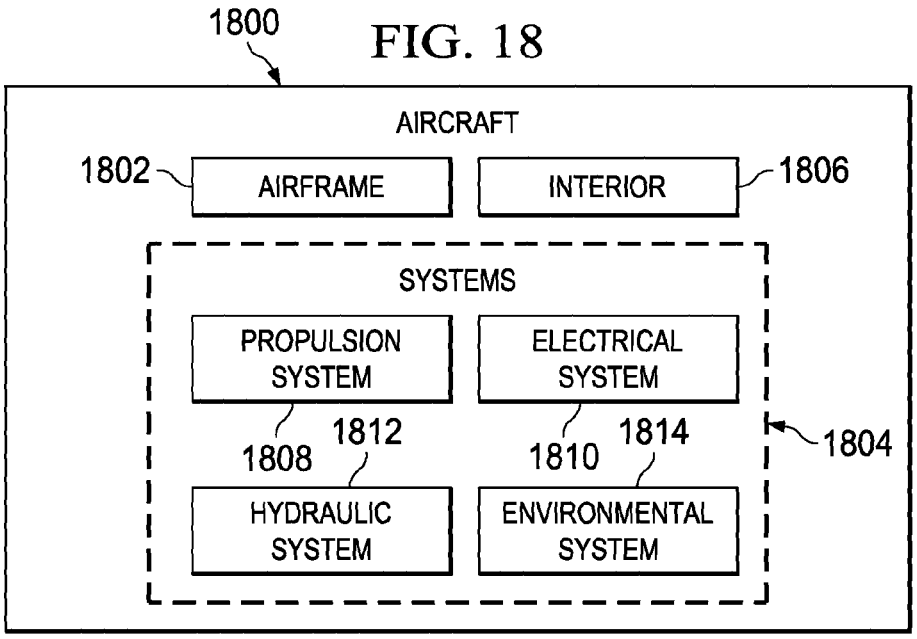
FIG. 18 is an illustration of an aircraft in the form of a block diagram in which an illustrative embodiment may be implemented.

Illustrative embodiments of the disclosure may be described in the context of aircraft manufacturing and service method 1700 as shown in FIG. 17 and aircraft 1800 as shown in FIG. 18. Turning first to FIG. 17, an illustration of an aircraft manufacturing and service method is depicted in the form of a flowchart in accordance with an illustrative embodiment. During pre-production, aircraft manufacturing and service method 1700 may include specification and design 1702 of aircraft 1800 in FIG. 18 and material procurement 1704.

During production, component and subassembly manufacturing 1706 and system integration 1708 of aircraft 1800 in FIG. 18 takes place. Thereafter, aircraft 1800 in FIG. 18 may go through certification and delivery 1710 in order to be placed in service 1712. While in service 1712 by a customer, aircraft 1800 in FIG. 18 is scheduled for routine maintenance and service 1714, which may include modification, reconfiguration, refurbishment, and other maintenance or service.

Each of the processes of aircraft manufacturing and service method 1700 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 18, an illustration of an aircraft is depicted in the form of a block diagram in which an illustrative embodiment may be implemented. In this example, aircraft 1800 is produced by aircraft manufacturing and service method 1700 in FIG. 17 and may include airframe 1802 with systems 1804 and interior 1806. Examples of systems 1804 include one or more of propulsion system 1808, electrical system 1810, hydraulic system 1812, and environmental system 1814. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1700 in FIG. 17. In particular, fluid dispensing system 102 from FIG. 1 may be used for dispensing, for example, without limitation, sealant 122, over various surfaces during any one of the stages of aircraft manufacturing and service method 1700. For example, without limitation, fluid dispensing system 102 from FIG. 1 may be used for sealing fastener elements installed for aircraft 1800 during at least one of component and subassembly manufacturing 1706, system integration 1708, routine maintenance and service 1714, or some other stage of aircraft manufacturing and service method 1700.

In one illustrative example, components or subassemblies produced in component and subassembly manufacturing 1706 in FIG. 17 may be fabricated or manufactured in a manner similar to components or subassemblies produced while aircraft 1800 is in service 1712 in FIG. 17. As yet another example, one or more apparatus embodiments, method embodiments, or a combination thereof may be utilized during production stages, such as component and subassembly manufacturing 1706 and system integration 1708 in FIG. 17. One or more apparatus embodiments, method embodiments, or a combination thereof may be utilized while aircraft 1800 is in service 1712 and/or during maintenance and service 1714 in FIG. 17. The use of a number of the different illustrative embodiments may substantially expedite the assembly of and/or reduce the cost of aircraft 1800.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, without limitation, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for forming and shaping a fillet at an interface, the method comprising:

dispensing a fluid from a nozzle onto the interface as the nozzle is moved along the interface to form the fillet; and working an exposed surface of the fillet using a spherical fairing element associated with the nozzle as the nozzle is moved along the interface and the fluid is dispensed from the nozzle.

2. The method of claim 1, wherein working the exposed surface of the fillet comprises:

fairing the exposed surface of the fillet using a curved shape of the spherical fairing element such that a cross-sectional shape of the exposed surface takes on a cross-sectional shape in a single pass of the nozzle being moved along the interface while the fluid is being dispensed from the nozzle.

3. The method of claim 2, wherein fairing the exposed surface of the fillet comprises:

fairing the exposed surface of the fillet using the curved shape of the spherical fairing element such that the cross-sectional shape of the exposed surface takes on the cross-sectional shape in the single pass of the nozzle being moved along the interface while the fluid is being dispensed from the nozzle, wherein the curved shape comprises a spherical shape.

4. The method of claim 1 further comprising:

controlling at least one of a rate or an amount of the fluid being dispensed out of the nozzle such that the fairing element is able to work the exposed surface of the fillet to have a cross-sectional shape.

5. The method of claim 1 further comprising:

receiving the fluid within the nozzle from a fluid source through a structure with which the nozzle is associated; and dispensing the fluid through an opening in the nozzle onto the interface as the nozzle is moved along the interface to form the fillet, wherein the opening has a position that is off-center relative to a center axis of the structure.

6. The method of claim 5 further comprising:

moving the nozzle relative to the structure in a direction along a center axis of the structure as the nozzle is moved along the interface such that the nozzle maintains contact with the exposed surface of the fillet as the nozzle is moved along the interface.

7. The method of claim 6, wherein moving the nozzle relative to the structure in the direction along the center axis of the structure comprises:

moving biasing the nozzle relative to the structure in the direction along the center axis of the structure using a spring associated with at least one of the structure and the nozzle, wherein the biasing element biases the nozzle away from the structure to allow dispensing of the fluid from the nozzle.

8. The method of claim 6, wherein moving the nozzle relative to the structure in the direction along the center axis of the structure comprises:

moving the nozzle relative to the structure in the direction along the center axis of the structure using a fluid pressure created by a fluid chamber located between an opening in the nozzle through which the fluid is dispensed and an end of the structure.

9. The method of claim 1, wherein dispensing the fluid from the nozzle comprises:

dispensing the fluid through an opening in the nozzle onto the interface while the nozzle is being moved along the interface to form the fillet.

10. A method for concurrently forming and shaping a fillet at an interface, the method comprising:

receiving a fluid within a nozzle from a fluid source through a structure with which the nozzle is associated;

moving the nozzle along the interface;

dispensing the fluid through an opening in the nozzle onto the interface as the nozzle is being moved along the interface to form the fillet;

fairing an exposed surface of the fillet using a curved shape of a spherical fairing element associated with the nozzle as the nozzle is being moved along the interface and the fluid is being dispensed from the nozzle in a single pass such that a cross-sectional shape of the exposed surface takes on a cross-sectional shape in which the curved shape comprises a spherical shape;

controlling at least one of a rate or an amount of the fluid being dispensed out of the nozzle such that the fairing element is able to work the exposed surface of the fillet to have the cross-sectional shape; and moving the nozzle relative to the structure in a direction along a center axis of the structure as the nozzle is moved along the interface using one of a spring and a fluid pressure created by a fluid chamber located between the opening in the nozzle and an end of the structure such that the nozzle maintains contact with the exposed surface of the fillet as the nozzle is moved along the interface.

* * * * *